US012601240B1

(12) United States Patent
Ehlinger et al.

(10) Patent No.: US 12,601,240 B1
(45) Date of Patent: Apr. 14, 2026

(54) BAFFLE COLLAR WITH DOUBLE TAPERED LOCK RING

(71) Applicant: Expro North Sea Limited, Aberdeenshire (GB)

(72) Inventors: Jeffry C. Ehlinger, Houston, TX (US); Beau H. Martin, Youngsville, LA (US)

(73) Assignee: Expro North Sea Limited, Aberdeenshire (GB)

( * ) Notice: Subject to any disclaimer, the term of this patent is extended or adjusted under 35 U.S.C. 154(b) by 0 days.

(21) Appl. No.: 18/999,711

(22) Filed: Dec. 23, 2024

(51) Int. Cl.
*E21B 33/16* (2006.01)
*E21B 17/14* (2006.01)

(52) U.S. Cl.
CPC ..... *E21B 33/167* (2020.05); *E21B 17/14* (2013.01)

(58) Field of Classification Search
CPC ..... E21B 33/167; E21B 33/16
See application file for complete search history.

(56) References Cited

U.S. PATENT DOCUMENTS 7,484,559 B2 2/2009 Vert et al.
8,490,691 B2 7/2013 Purkis
8,616,289 B2 12/2013 Nguyen et al.
8,636,058 B2 1/2014 Nguyen et al.
9,719,319 B2 8/2017 Doane
10,000,991 B2 6/2018 Harris et al.
10,526,868 B2 1/2020 Walton et al.
10,571,027 B2 2/2020 Markiw et al.
10,975,655 B2 4/2021 Rochen et al.
11,396,786 B1 7/2022 Budde
11,434,715 B2 9/2022 Harris et al.
11,434,717 B2 9/2022 Jacob
12,055,012 B1 * 8/2024 Elkhalil ..... E21B 43/10
2011/0240307 A1 * 10/2011 Nguyen ..... E21B 33/035 166/360
2015/0101801 A1 * 4/2015 Budde ..... E21B 33/14 166/387
2016/0222752 A1 * 8/2016 Fripp ..... C08K 5/092
2018/0320472 A1 * 11/2018 Fripp ..... C22C 21/00
2023/0046556 A1 * 2/2023 Al-Dossary ..... E21B 34/103
2025/0101829 A1 * 3/2025 Horn ..... E21B 33/16

* cited by examiner

*Primary Examiner* — David Carroll
(74) *Attorney, Agent, or Firm* — Patterson + Sheridan, LLP

(57) ABSTRACT

Embodiments of the present disclosure relate to a cementing system. In one embodiment, cementing system includes a float shoe and a collar system. The collar system includes a baffle collar; an inner string, a plug stem, and a sealing plug. The sealing plug includes a lock ring cavity and a lock ring. The lock ring cavity includes an upper cavity tapered surface and a lower cavity tapered surface. The lock ring includes a tapered surface. The tapered surface includes an upper ring tapered surface and a lower ring tapered surface.

20 Claims, 6 Drawing Sheets

BAFFLE COLLAR WITH DOUBLE TAPERED LOCK RING

BACKGROUND

Field

Embodiments of the present disclosure generally relate to an apparatus and method for cementing subsurface wellbores. In particular, the present disclosure relates to an anchoring device to provide a seal against pressure from above or below a baffle collar.

Description of the Related Art

In the resource recovery industry, more specifically in hydrocarbon recovery, it is sometime desirable to set a pressure barrier within the casing or liner after the casing or liner has been deployed in the wellbore. The pressure barrier locks and seals the casing or liner in place against pressure of any sub-surface flow. If the casing or liner includes apertures, such as slots and/or sand control screens, the barrier may be installed in order to fluidically isolate the apertures from another zone in the wellbore. Well barriers, such as bridge plugs, cement retainers, or other mechanical isolation devices, isolate the lower zone (e.g., a zone that is further down hole) of the wellbore permanently or temporarily, sealing it from the upper zone (e.g., a zone that is further up bore) of the wellbore. Typically, the installation of the pressure barrier is achieved by running a bridge plug with a setting tool into the wellbore, setting the bridge plug in the casing or liner, and then retrieving the setting tool from the wellbore.

However, running and setting the casing or liner in the wellbore requires a first trip into the wellbore, and installation of the bridge plug requires a second trip into the wellbore. When installing the bridge plug, the cement in a float shoe must be drilled out, followed by a scraper or clean out run. Once the clean out run is complete, the bridge plug is run and set into the area of the shoe track that was cleaned out. The separate drill/clean out trip, which is required to access to a portion of the shoe track to properly locate the bridge plug, involves additional time and expense. Furthermore, bridge plugs typically include gripping elements, or slips, that bite into the casing or liner in order to anchor the bridge plug to the casing or liner. The slips may cause damage to the interior surface of the casing or liner. The damage caused by the slips may make the casing or liner susceptible to corrosion and/or stress corrosion cracking. Therefore, there is a need for improved pressure barriers and methods of setting the pressure barriers.

SUMMARY

In one embodiment, a cementing system is disclosed. The cementing system includes a float shoe and a collar system. The collar system includes a baffle collar; an inner string, a plug stem, and a sealing plug. The sealing plug includes a lock ring cavity and a lock ring. The lock ring cavity includes an upper cavity tapered surface and a lower cavity tapered surface. The lock ring includes a tapered surface. The tapered surface includes an upper ring tapered surface and a lower ring tapered surface.

In another embodiment, an anchoring device disposed in a tubular is disclosed. The anchoring device includes a lock ring cavity and a lock ring. The lock ring cavity includes an upper cavity tapered surface and a lower cavity tapered surface. The lock ring includes a tapered surface. The tapered surface includes an upper ring tapered surface and a lower ring tapered surface.

In yet another embodiment, a sealing plug is disclosed. The sealing plug includes a lock ring cavity and a lock ring. The lock ring cavity includes an upper cavity tapered surface and a lower cavity tapered surface. The lock ring includes a tapered surface. The tapered surface includes an upper ring tapered surface and a lower ring tapered surface.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to an apparatus and method for cementing subsurface wellbores. In particular, the present disclosure relates to an anchoring device to provide a seal against pressure from above or below a baffle collar.

The present disclosure includes a cementing system to deliver inner string cementing for the wellbore. The cementing system includes a collar system including a sealing plug having a double tapered lock ring. The sealing plug is set into the collar in tension, and serves to replace a bridge plug as the pressure barrier in the well.

The pre-installed collar system of the cementing system provides efficient downhole cementing operations, which would replace the conventional bridge plug. The pre-installed collar system is designed such that it allows cementation of the wellbore, followed by an inner string of the collar system being disconnected and pulled out of the collar system, leaving the sealing plug set into the collar in place of the bridge plug, as the pressure barrier in the well. The sealing plug eliminates the need for shoe tracks, providing improved cement placement, drill out performance, and reduced need for remedial cementing.

The double tapered lock ring increases the holding power of the sealing plug, regardless of the direction of the force. Thus, the sealing plug provides a reliable barrier in the wellbore and saves rig time and reduces costs, risks, and unproductive time, providing a range of major operational benefits to drilling and field development operations.

Figure 1:
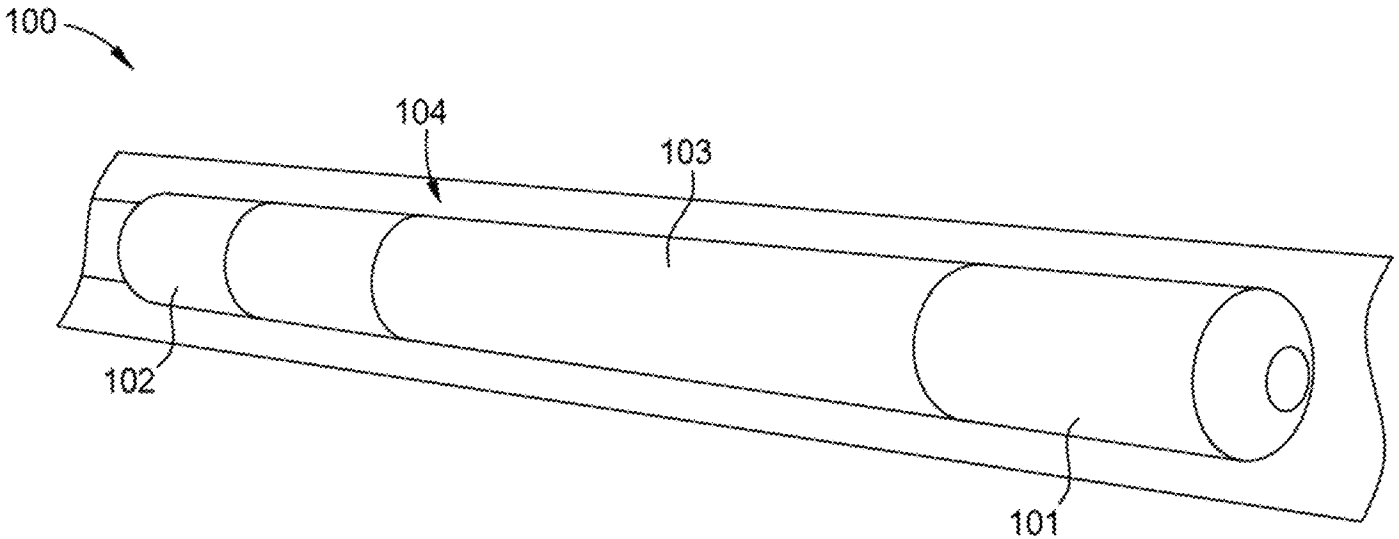
FIG. 1 is a perspective view of a packer system disposed in a wellbore, according to embodiments herein.

FIG. 1 is a cementing system 100. The cementing system 100 includes a float shoe 101, a collar system 102, and an intermediate body 103 connecting the collar system 102 and the float shoe 101. One cementing system 100 that can benefit from the present disclosure is the BarrierCure™ System utilizing the SeaCure™ inner string from EXPRO. The cementing system 100 is run into the wellbore 104 to a region for which cementing is desired. The cementing system 100 may be attached to tubing upstream of the cementing system 100 to run the cementing system 100 to a desired depth in the wellbore 104. In some applications, the cementing system 100 sets a pressure barrier within the casing or liner after the casing or liner has been deployed in the wellbore 104. The pressure barrier locks and seals the casing or liner in place against pressure of any sub-surface flow. Cement flows through the tubing upstream of the cementing system 100, the collar system 102, the intermediate body 103, and the float shoe 101 to secure the casing or liner in the wellbore 104.

Figure 2A:
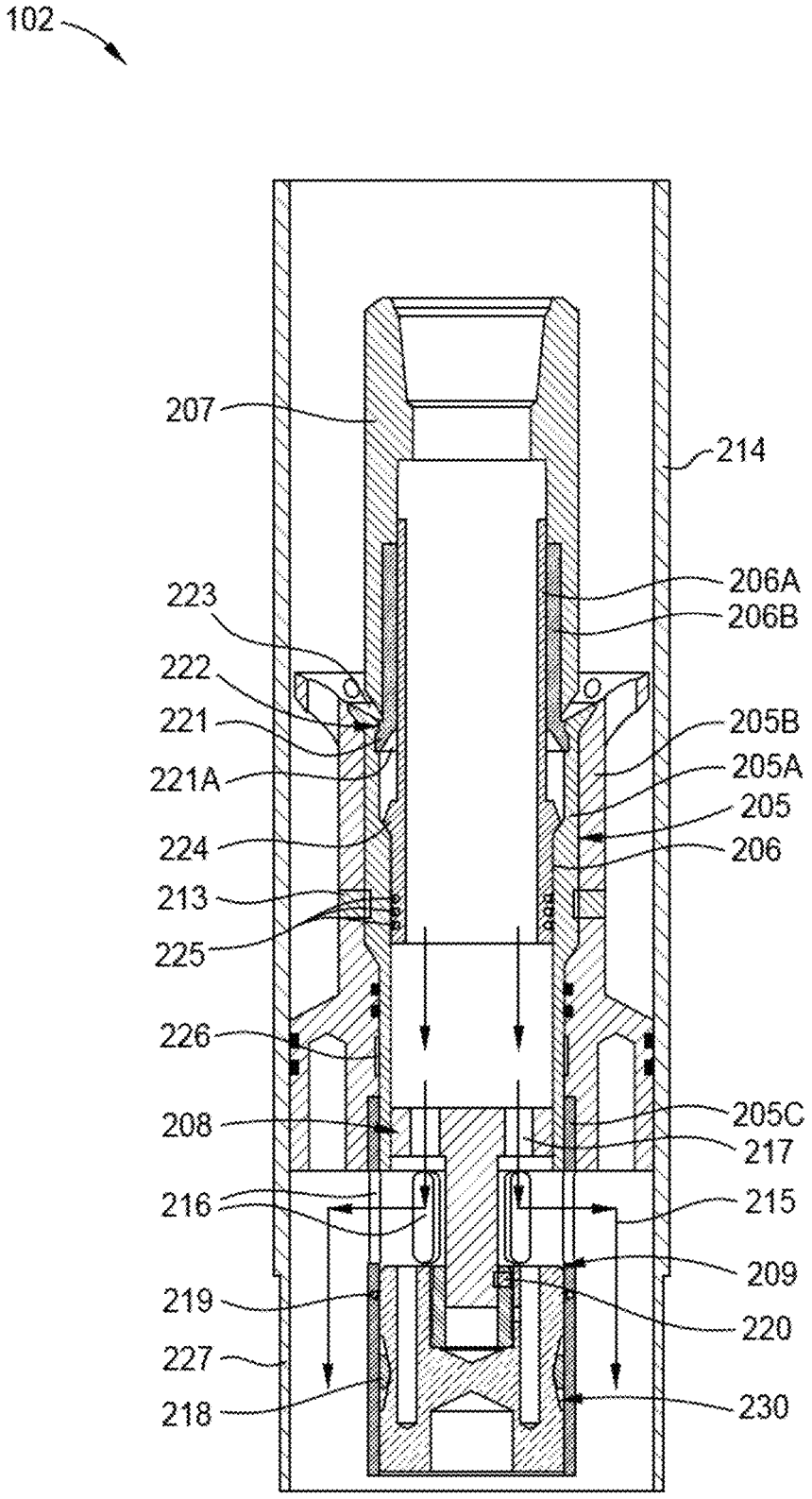
FIG. 2A is a cross-sectional view of a packer assembly in the unactuated position within the casing, according to embodiments herein.

FIG. 2A is a cross-sectional view of a baffle collar 205 of the collar system 102 in the cementing position. The collar system 102 includes a baffle collar 205, an inner string 206, a latch-in adaptor 207, a plug stem 208, and an anchoring device (e.g., a sealing plug 209). The baffle collar 205 includes an inner collar 205A, an outer collar 205B, and a flow section. The inner collar 205A and the outer collar 205B are coupled together via baffle collar shear pins 213. The inner string 206 includes an inner portion 206A and an outer portion 206B surrounding the inner portion 206A. The collar system 102 is run into a casing 214 disposed in the wellbore 104. The latch-in adaptor 207 is configured to connect the inner string 206 to tubing that is upstream of the inner string 206. The casing 214 includes a coupling surface 227 configured to connect the casing 214 to tubing that is downstream of the casing 214, such as the intermediate body 103.

The inner string 206 is extended into the casing 214 to supply the cement or settable material from the surface. The inner string 206 is secured to the baffle collar 205 via an expandable shoulder 221 of the outer portion 206B. The inner string 206 is extended into the casing until the expandable shoulder 221 engages a shoulder receiver 222 of the baffle collar 205. The expandable shoulder 221 is depressed against the shoulder receiver 222 of the baffle collar 205 as the inner string 206 extends into the baffle collar 205 to enable the expandable shoulder 221 to move past the shoulder receiver 222. The expandable shoulder 221 is depressed as the expandable shoulder 221 moves along a tapered surface 223 of the shoulder receiver 222. A plurality of inner string seals (e.g., O-rings) 225 create a seal between the inner string 206 and the baffle collar 205.

The sealing plug 209 includes a double tapered lock ring 218 disposed in a tapered lock ring cavity 230. A sealing plug seal 219 create a seal between the sealing plug 209 and the flow section 205C of the baffle collar 205. The plug stem 208 couples the inner collar 205A of the baffle collar to the sealing plug 209. The sealing plug 209 is coupled to the plug stem 208 via a sealing plug shear pin 220. The double tapered lock ring 218 is configured to engage a lock ring channel 226 of the outer collar 205B of the baffle collar 205 in a retrieval position and a shearing position.

Once in the cementing position, the cement flows along a flow path 215 within the collar system 102. The cement flows along the flow path 215 through one or more apertures 217 in the plug stem 208 and exits the collar system 102 via cement openings 216 in flow section 205C of the baffle collar 205. After exiting the collar system 102, the cement flows out of the collar system 102, through the intermediate body 103, and into the wellbore 104 via the float shoe 101. The cement sets a pressure barrier within the casing 214 and partially fills an annulus of the wellbore 104 surrounding the casing 214, securing the casing 214 in the wellbore 104.

Figure 2B:
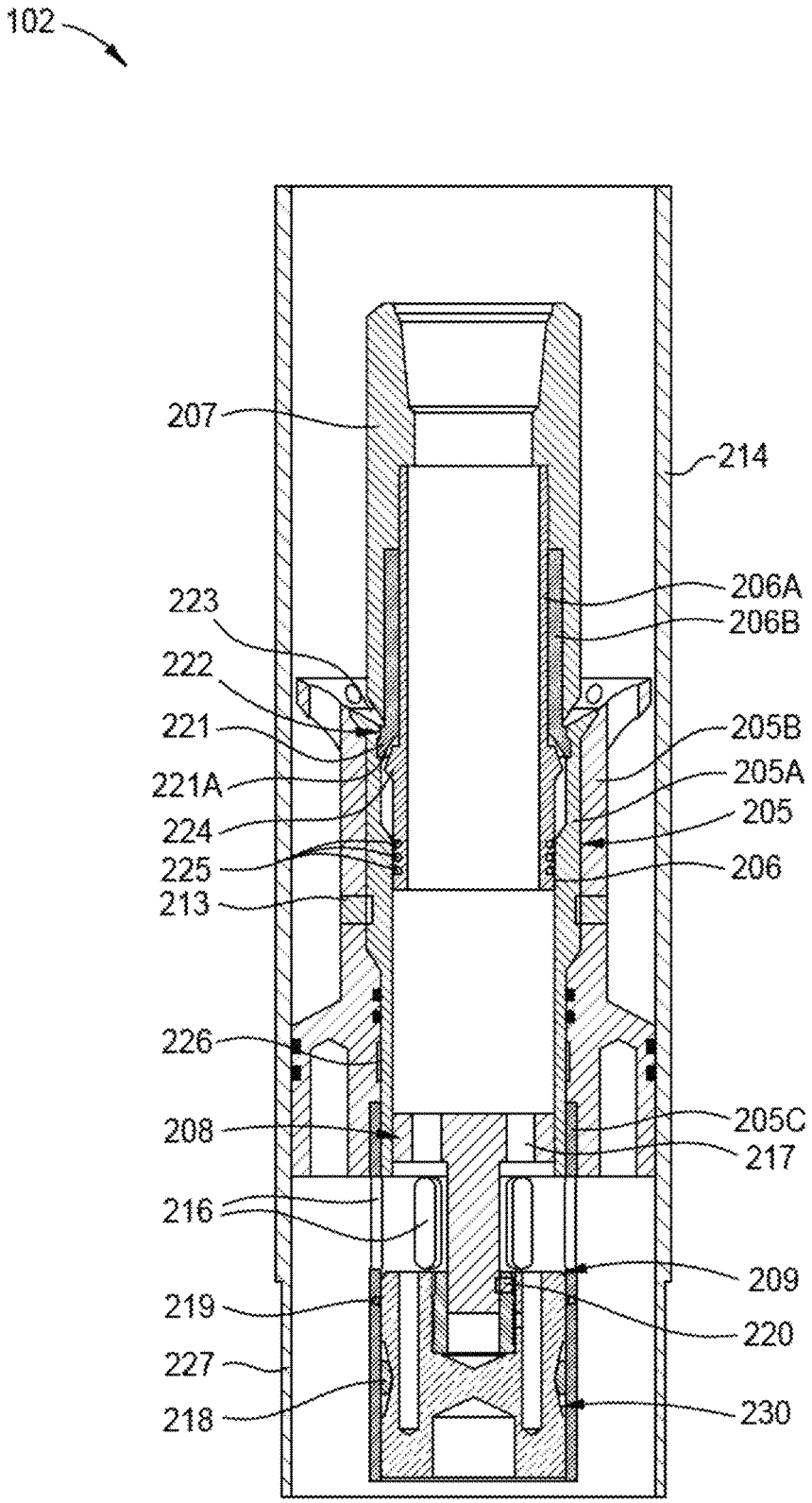
FIG. 2B is a cross-sectional view of a packer assembly in an actuated position within the casing, according to embodiments herein.

FIG. 2B is a cross-sectional view of the collar system 102 in the retrieval position. After the desired volume of cement is pumped through the inner string 206 and into the annular region of the wellbore 104, the inner string 206, plug stem 208, and sealing plug 209 are pulled up bore. As the inner string 206 is pulled up bore, an anti-depression collar 224 of the inner portion 206A of the inner string 206 engages an inner annulus 221A of the expandable shoulder 221. The anti-depression collar 224 is configured to fit within the inner annulus 221A of the expandable shoulder 221 in order to prevent the expandable shoulder 221 from depressing as the inner string 206 is pulled up bore. As the inner string 206 continues to be pulled up bore, the expandable shoulder 221 exerts a force on the shoulder receiver 222 of the inner collar 205A. The force on the inner collar 205A causes the baffle collar shear pins 213 between the inner collar 205A and the outer collar 205B to shear into an inner collar shear portion 213A and an outer collar shear portion 213B, decoupling the inner collar 205A from the outer collar 205B. The baffle collar shear pins 213 are configured to shear at a first shear pressure.

As the plug stem 208 and the sealing plug 209 are pulled up bore, the double tapered lock ring 218 of the sealing plug 209 engages the lock ring channel 226 of the outer collar 205B, securing the sealing plug 209 within the baffle collar 205. A plurality of sealing rings 231 form a seal between the sealing plug 209 and the outer collar 205B of the baffle collar 205.

Figure 2C:
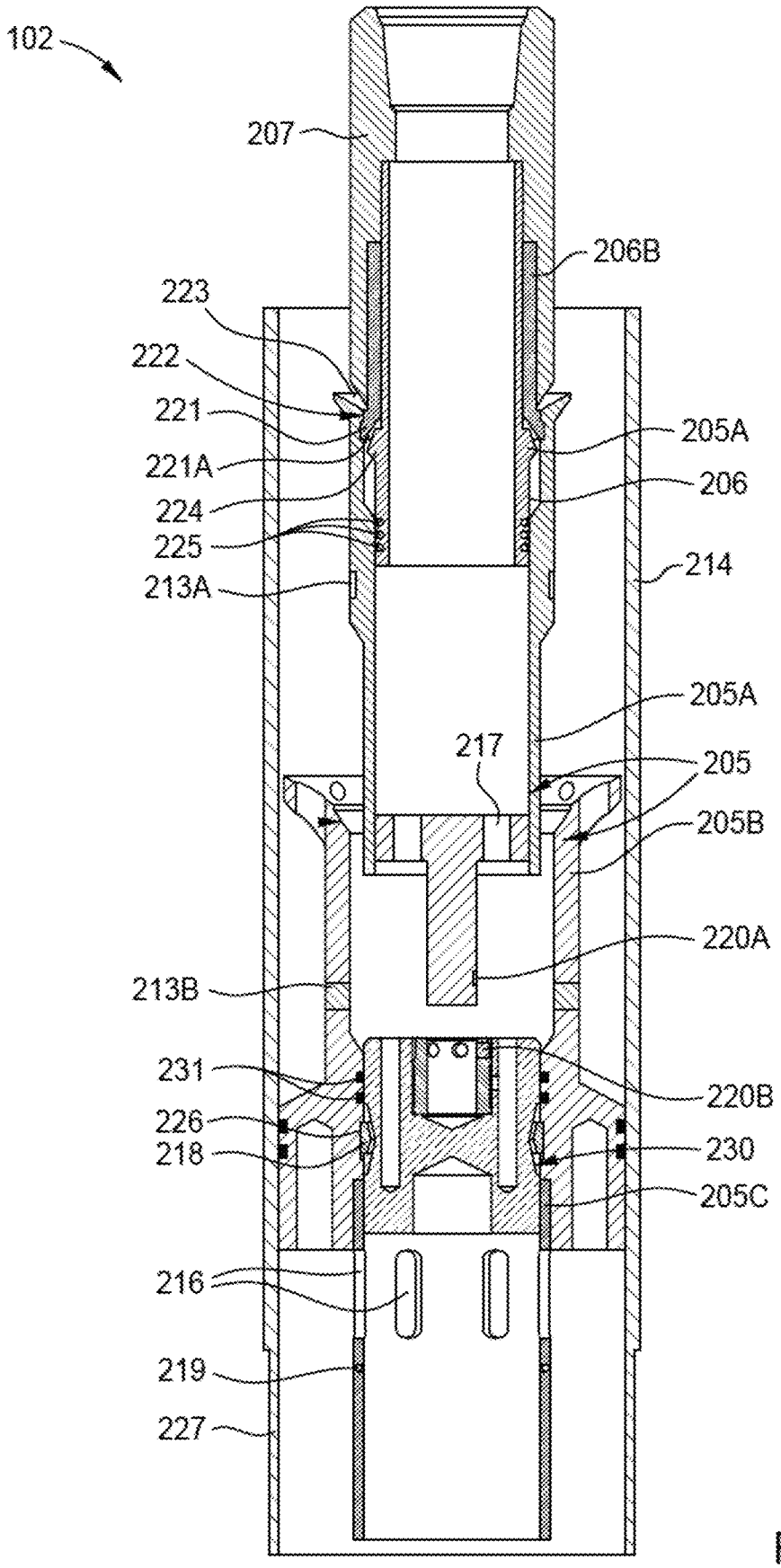
FIG. 2C is a cross-sectional view of a packer assembly in an actuated position within the casing, according to embodiments herein.

FIG. 2C is a cross-sectional view of the collar system 102 in the shearing position. As the inner string 206 and the plug stem 208 continue to be pulled up bore, the sealing plug shear pin 220 is sheared into a plug stem shear portion 220A and a sealing plug shear portion 220B, decoupling the plug stem 208 from the sealing plug 209. The sealing plug shear pin 220 is configured to shear at a second shear pressure. The second shear pressure is greater than the first shear pressure.

Figure 3:
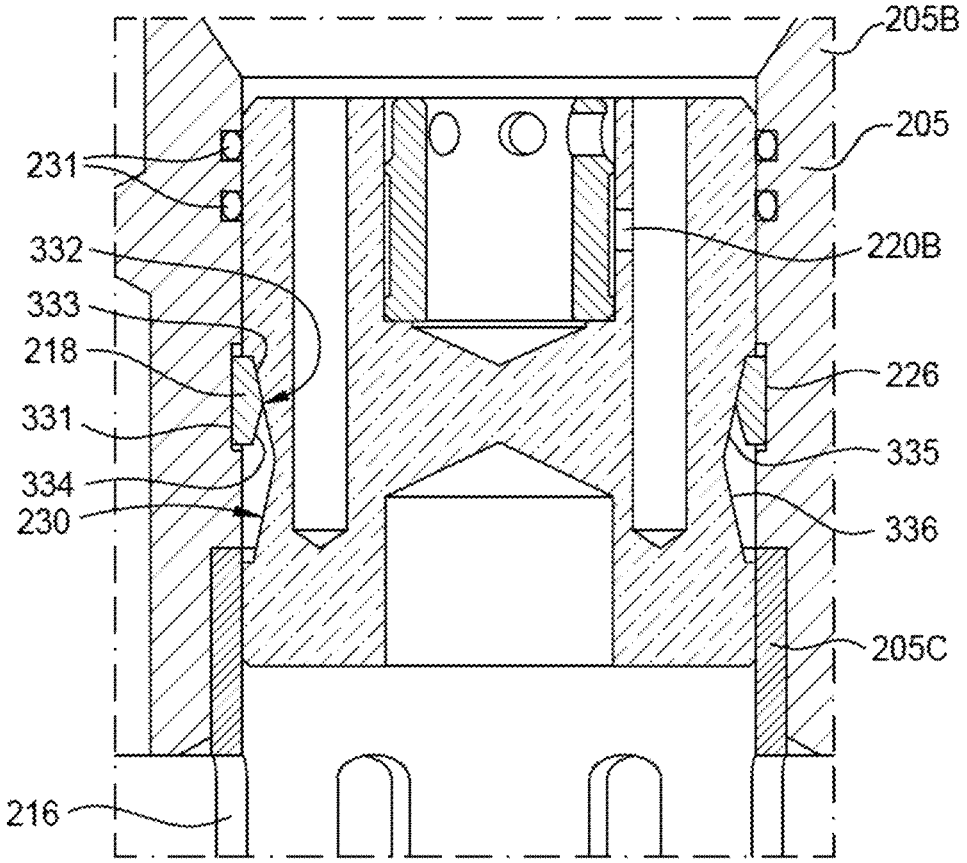
FIG. 3 is a cross-sectional view of a sealing plug in a shearing position, according to embodiments herein.

FIG. 3 is a cross-sectional view of the sealing plug 209 in the shearing position. The double tapered lock ring 218 is disposed in the double tapered lock ring cavity 230 of the sealing plug 209. During manufacturing of the sealing plug 209, the double tapered lock ring 218 is compressed into the double tapered lock ring cavity 230 as the sealing plug 209 is inserted into the baffle collar 205. The double tapered lock ring cavity 230 is sized, relative to the double tapered lock ring 218, such that the double tapered lock ring 218 is able to move within the double tapered lock ring cavity 230. The ability of the double tapered lock ring 218 to move within the double tapered lock ring cavity 230 enables the double tapered lock ring 218 to properly sit within the double tapered lock ring cavity 230. When in the retrieval position and the shearing position, the double tapered lock ring 218 engages the lock ring channel 226 of the outer collar 205B, securing the sealing plug 209 within the baffle collar 205. The sealing plug 209 comprises an aluminum material, or other drillable materials, in order to enable the sealing plug 209 to be drilled out in the future to enable other downhole operations.

The double tapered lock ring 218 includes a flat surface 331 and a double tapered surface 332. The flat surface 331 is disposed within the lock ring channel 226. The double tapered surface 332 includes an upper ring tapered surface 333 and a lower ring tapered surface 334. The double tapered lock ring cavity 230 includes an upper cavity tapered surface 335 and a lower cavity tapered surface 336. The upper ring tapered surface 333, the lower ring tapered surface 334, the upper cavity tapered surface 335, and the lower cavity tapered surface 336 have matching taper angles.

When a force is applied against the sealing plug 209 from down bore (e.g., the force is being applied against the sealing plug 209 to force the sealing plug 209 up bore), the lower cavity tapered surface 336 applies a force against the lower ring tapered surface 334. When a force is applied against the sealing plug from up bore (e.g., the force is being applied against the sealing plug 209 to force the sealing plug 209 down bore), the upper cavity tapered surface 335 applies a force against the upper ring tapered surface 333. The force being applied by the sealing plug 209 against the double tapered lock ring 218 is distributed between the vertical and horizontal direction due to the tapered surfaces of the sealing plug 209 and the double tapered lock ring 218, causing the double tapered lock ring 218 to be compressed within the lock ring channel 226. The force distribution enables the sealing plug 209 and double tapered lock ring 218 to experience higher forces/pressures within the wellbore 104 without the double tapered lock ring 218 shearing and failing. The sealing plug 209 and double tapered lock ring 218 can withstand a bi-directional pressure of about 5 ksi to about 30 ksi, such as about 10 ksi to about 10 ksi to about 20 ksi, such as about 13 ksi to about 17 ksi, such as about 15 ksi to about 30 ksi, such as about 25 ksi to about 30 ksi, at a temperature of about 400° F. The sealing plug 209 and the double tapered lock ring 218 can withstand a bi-directional pressure that is greater than the pressure at which the sealing plug shear pin 220 is configured to shear.

Figure 4:
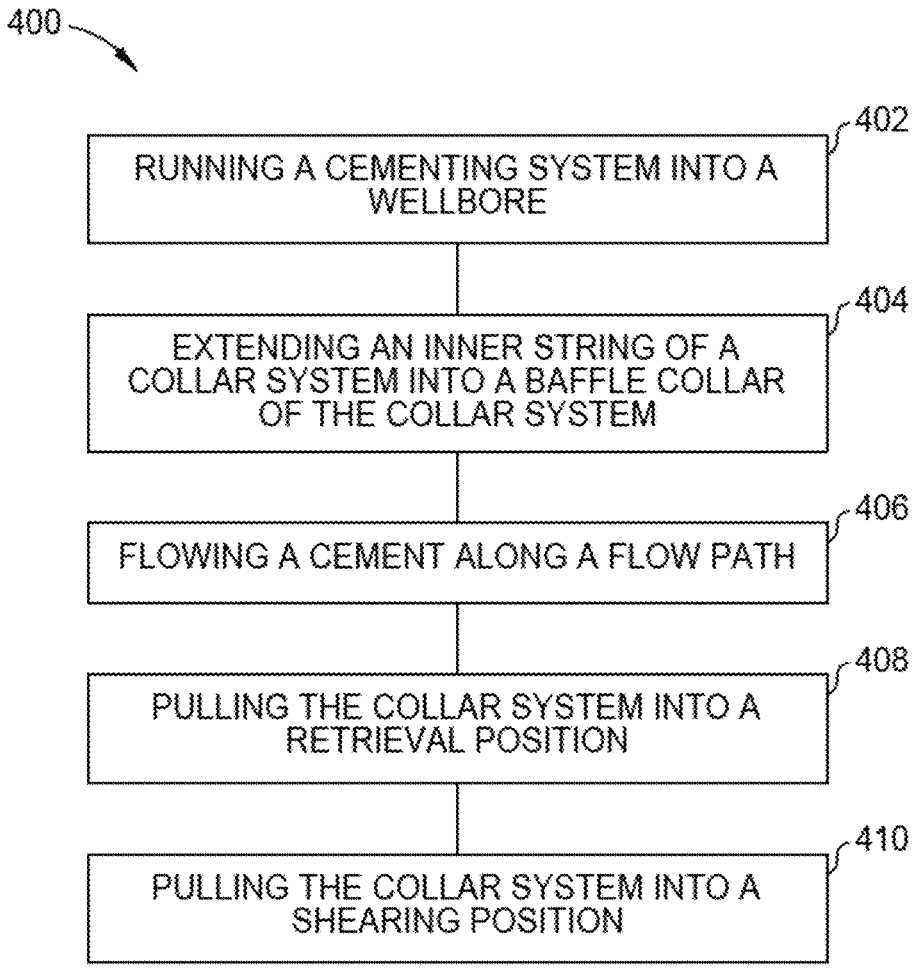
FIG. 4 is a flow diagram of a method of securing a casing in a wellbore, according to embodiments herein.

FIG. 4 is a method 400 of securing a casing 214 in a wellbore 104. The method 400 utilizes a cementing system 100, as shown in FIG. 1. At operation 402, the cementing system 100 is run into the wellbore 104 to a region for which cementing is desired. The cementing system 100 is attached to tubing upstream of the cementing system 100 to run the cementing system 100 to a desired depth in the wellbore 104.

At operation 404, as shown in FIG. 2A, an inner string 206 of the collar system 102 is extended into a baffle collar 205 of the collar system 102. An inner string 206 of a collar system 102 of the cementing system 100 is extended into the casing 214 to supply the cement or settable material from the surface. The inner string 206 is secured to a baffle collar 205 of the collar system 102. The inner string 206 is extended into the casing until an expandable shoulder 221 engages a shoulder receiver 222 of the baffle collar 205. The expandable shoulder 221 is depressed as the expandable shoulder 221 moves along a tapered surface 332 of the shoulder receiver 222 to enable the expandable shoulder 221 to move past the shoulder receiver 222.

At operation 406, as shown in FIG. 2A, a cement is flowed along a flow path 215. The cement flows along the flow path 215 through apertures 217 in a plug stem 208 and exits the collar system 102 via cement openings 216 in a flow section 205C of the baffle collar 205. After exiting the collar system 102, the cement flows out of the collar system 102, through the intermediate body 103, and into the wellbore 104 via the float shoe 101. The cement sets a pressure barrier within the casing 214 and partially fills an annulus of the wellbore 104 surrounding the casing 214, securing the casing 214 in the wellbore 104.

At operation 408, as shown in FIG. 2B, the collar system 102 is pulled into a retrieval position. After the desired volume of cement is pumped through the inner string 206 and into the annular region of the wellbore 104, the inner string 206, plug stem 208, and sealing plug 209 are pulled up bore into a retrieval position. As the inner string 206 is pulled up bore, the expandable shoulder 221 exerts a force on the shoulder receiver of the inner collar 205A. The force on the inner collar 205A causes the baffle collar shear pins 213 between the inner collar 205A and the outer collar 205B to shear, decoupling the inner collar 205A from the outer collar 205B. The baffle collar shear pins 213 are configured to shear at a first shear pressure. The double tapered lock ring 218 of the sealing plug 209 engages the lock ring channel 226 of the outer collar 205B, securing the sealing plug 209 within the baffle collar 205.

At operation 410, as shown in FIG. 2C, the collar system is pulled into a shearing position. As the inner string 206 and the plug stem 208 continue to be pulled up bore, a sealing plug shear pin 220 is sheared into a plug stem shear portion 220A and a sealing plug shear portion 220B, decoupling the plug stem 208 from the sealing plug 209. The sealing plug shear pin 220 is configured to shear at a second shear pressure. The second shear pressure is greater than the first shear pressure. The sealing plug 209 remains in the wellbore 104 until the sealing plug is drilled out in the future to enable other downhole operations. The sealing plug includes a double tapered lock ring 218 and a double tapered lock ring cavity 230. The sealing plug 209 and double tapered lock ring 218 can withstand a bi-directional pressure of about 5 ksi to about 30 ksi, such as about 10 ksi to about 10 ksi to about 20 ksi, such as about 13 ksi to about 17 ksi, such as about 15 ksi to about 30 ksi, such as about 25 ksi to about 30 ksi, at a temperature of about 400° F. The sealing plug 209 and the double tapered lock ring 218 can withstand a bi-directional pressure that is greater than the pressure at which the sealing plug shear pin 220 is configured to shear.

In summary, the present disclosure relates to a cementing system that utilizes a sealing plug with a double tapered cavity and a double tapered lock ring. When a force is applied to the sealing plug, from either up bore or down bore, the force being is distributed between the vertical and horizontal direction due to the tapered surfaces of the sealing plug and the double tapered lock ring, causing the double tapered lock ring to be compressed within the lock ring channel. The force distribution enables the sealing plug and double tapered lock ring to experience higher forces/pressures within the wellbore without the double tapered lock ring shearing and failing. The cementing system replaces the conventional bridge plug, which required additional time and expense to properly set the pressure barrier. Therefore, the cementing system decreases downtime and cost associated with setting a pressure barrier downhole after the cementing operation.

The term "comprises" and grammatical equivalents thereof are used herein to mean that other components, ingredients, operations, etc. are optionally present. For example, an article "comprising" (or "which comprises") components A, B, and C can consist of (i.e., contain only) components A, B, and C, or can contain not only components A, B, and C but also one or more other components.

In addition, whenever a composition, an element or a group of elements is preceded with the transitional phrase "comprising" or grammatical equivalents thereof, it is understood that it is contemplated that the same composition or group of elements may be preceded with transitional phrases "consisting essentially of," "consisting of," "selected from the group of consisting of," or "is" preceding the recitation of the composition, element, or elements and vice versa.

Where reference is made herein to a method comprising two or more defined operations, the defined operations can be carried out in any order or simultaneously (except where the context excludes that possibility), and the method can include one or more other operations which are carried out before any of the defined operations, between two of the defined operations, or after all of the defined operations (except where the context excludes that possibility).

When introducing elements of the present disclosure or exemplary aspects or implementation(s) thereof, the articles "a," "an," "the" and "said" are intended to mean that there are one or more of the elements.

The terms "comprising," "including" and "having" are intended to be inclusive and mean that there may be additional elements other than the listed elements.

While the foregoing is directed to implementations of the present disclosure, other and further implementations of the disclosure may be devised without departing from the basic scope thereof, and the scope thereof is determined by the claims that follow.

What is claimed is:

1. A cementing system, comprising:
a float shoe; and
a collar system, comprising:
a baffle collar;
an inner string;
a plug stem;
a sealing plug, comprising:
a lock ring cavity comprising:
an upper cavity tapered surface; and
a lower cavity tapered surface; and
a lock ring having a tapered surface, the tapered surface comprising:
an upper ring tapered surface; and
a lower ring tapered surface.

2. The cementing system of claim 1, wherein the sealing plug can withstand a bi-directional pressure of 5 ksi to 30 ksi.

3. The cementing system of claim 1, wherein the sealing plug comprises an aluminum material.

4. The cementing system of claim 1, wherein the sealing plug is coupled to the baffle collar via the plug stem, the plug stem comprising one or more apertures.

5. The cementing system of claim 1, wherein the sealing plug is coupled to the plug stem via a sealing plug shear pin.

6. The cementing system of claim 5, wherein the baffle collar further comprises:
an inner collar;
an outer collar; and
a baffle collar shear pin, wherein the inner collar and the outer collar are coupled together via the baffle collar shear pin having a first shear pressure.

7. The cementing system of claim 6, wherein the sealing plug shear pin has a second shear pressure greater than the first shear pressure.

8. An anchoring device installed in a tubular, comprising:
a body defining a lock ring cavity comprising:
an upper cavity tapered surface; and
a lower cavity tapered surface; and
a lock ring comprising:
an upper ring surface; and
a lower ring surface.

9. The anchoring device of claim 8, wherein the anchoring device comprises an aluminum material.

10. The anchoring device of claim 8, wherein the lock ring is configured to engage a lock ring channel of a baffle collar and the anchoring device can withstand a bi-directional pressure of 5 ksi to 30 ksi.

11. The anchoring device of claim 10, wherein an inner collar of the baffle collar is coupled to an outer collar of the baffle collar via a baffle collar shear pin having a first shear pressure.

12. The anchoring device of claim 11, wherein the anchoring device is coupled to the baffle collar via a plug stem.

13. The anchoring device of claim 12, wherein the anchoring device is coupled to the plug stem via a sealing plug shear pin, wherein the sealing plug shear pin has a second shear pressure greater than the first shear pressure.

14. The anchoring device of claim 13, wherein the lock ring further comprises;
a tapered surface comprising:
an upper ring tapered surface;
a lower ring tapered surface; and
a flat surface opposite the tapered surface, and wherein the flat surface is disposed within the lock ring channel.

15. An anchoring device, comprising:
a body defining a lock ring cavity, comprising:
an upper cavity surface; and
a lower cavity surface; and
a lock ring having a tapered surface, the tapered surface comprising:
an upper ring tapered surface; and
a lower ring tapered surface.

16. The anchoring device of claim 15, wherein the anchoring device can withstand a bi-directional pressure of 5 ksi to 30 ksi.

17. The anchoring device of claim 15, comprising an aluminum material.

18. The anchoring device of claim 15, wherein the lock ring is configured to engage a lock ring channel of a baffle collar of a cementing system to create a pressure barrier between a first region up bore from the cementing system and a second region down bore from the cementing system.

19. The anchoring device of claim 18, wherein the lock ring further comprises a flat surface opposite the tapered surface.

20. The anchoring device of claim 19, wherein the flat surface is disposed within the lock ring channel.

* * * * *